United States Patent [19]

Szabo

[11] Patent Number: 4,886,688

[45] Date of Patent: Dec. 12, 1989

[54] TREE ORNAMENT

[76] Inventor: Alice E. Szabo, 1146 Indian Summer Ave., LaPuente, Calif. 91744

[21] Appl. No.: 115,816

[22] Filed: Nov. 2, 1987

[51] Int. Cl.[4] ..... A41G 1/04; A47G 33/08

[52] U.S. Cl. ..... 428/7; 428/10; 428/27

[58] Field of Search ..... 428/7, 10, 27; D11/119, D11/120, 121; 493/957, 958

[56] References Cited

U.S. PATENT DOCUMENTS

| | | | |
|---|---|---|---|
| D. 113,358 | 2/1939 | Becker et al. | D5/53 |
| D. 113,848 | 3/1939 | Kranz et al. | D11/121 |
| D. 259,910 | 7/1981 | Simmons | 428/10 X |
| 362,017 | 4/1887 | Landenberger | 428/10 X |
| 424,916 | 4/1890 | Wilmsen | 428/10 |
| 1,773,580 | 8/1930 | Franke | D11/119 X |
| 1,792,676 | 2/1931 | Christastie | 428/10 X |
| 2,258,442 | 10/1941 | Brenner | 428/10 X |
| 2,880,540 | 4/1959 | Williams | 428/10 |
| 2,997,800 | 8/1961 | Ross | 428/7 |
| 3,096,766 | 7/1963 | Patton | 428/11 X |
| 3,110,647 | 11/1963 | Tong | 428/10 X |
| 3,124,856 | 3/1964 | Fleminger | 428/7 X |
| 3,677,867 | 7/1972 | Westlund | 428/9 |
| 4,144,365 | 3/1979 | Scudder et al. | 428/10 |
| 4,145,731 | 3/1979 | Adamich | 428/7 X |
| 4,525,393 | 6/1985 | DiCostanzo | 428/7 |
| 4,542,446 | 9/1985 | Shiff et al. | 428/10 X |

FOREIGN PATENT DOCUMENTS

| | | | |
|---|---|---|---|
| 735988 | 8/1955 | United Kingdom | 428/10 |

*Primary Examiner*—Henry F. Epstein

*Attorney, Agent, or Firm*—Boniard I. Brown

[57] ABSTRACT

A tree ornament in the form of a disc having a central mounting band which may be elastic, a stiff annular member or a disconnectable ring around which is attached suitable decorative materials, such as a tinsel rope with the tinsel strips extending radially outward from the center of the disc. The ornament is easily mounted on a tree by extending a branch through the central opening formed by the central mounting band so that the ornament forms a halo of tinsel normal to the branch.

7 Claims, 2 Drawing Sheets

TREE ORNAMENT

BACKGROUND OF THE PRESENT INVENTION

Many different types of pleasing ornaments for decorating Christmas trees, wreaths and other indications of festive seasons are available. Most include a decorative portion and a separate attachment means for attaching the ornament or decoration to the item being decorated. Some decorations having separate means of support are shown in U.S. Pat. No. 3,124,856 to FLEMINGER, whereas in others, wire, metal or cardboard rings are used as the base for the decoration. Such are shown by KRANZ, et al, U.S. Design Pat. No. 113,848 and BRENNER, U.S. Pat. No. 2,258,442. In other cases, such as ROSS, U.S. Pat. No. 2,997,800 a clip is used to form part of the decoration with tinsel hanging therefrom. In fact, some decorations like those of WILLIAMS, shown in U.S. Pat. No. 2,880,540, are of very simple construction, where several sheets of metallic foil taped together are formed into a ring with its edges slit and curled to form a decorative garland.

BRIEF DESCRIPTION OF THE PRESENT INVENTION

The present invention is disc-shaped having a center annulus. In some embodiments the annulus is an elastic band while in others it is a stiff annular ring member which may or may not be decorated, or a wire loop with suitable hooks on the ends so that it can be opened for easy attachment and removal from the branch of a tree or bush. In all embodiments of the present invention, it is intended that the center annulus be positioned with a branch extending therethrough so that the ornament is retained normal to the branch in a decorative position. Tinsel rope or other suitable decoration is connected to the center portion so that it extends radially outwardly therefrom to form a halo-like effect about the branch. The tinsel rope may be connected to the elastic band by suitable flexible means, or to the stiff annular member by glue or other means, such as staples. With the wire embodiment it is preferable to threadably attach the tinsel rope to the wire loop, however any flexible connection method can be used.

Therefore, it is an object of the present invention to provide a pleasing ornament which is easily constructed for sale at a reasonable price.

Another object is to provide a new and unusual ornament for trees so that they can be decorated in a novel fashion.

Another object is to provide a decorative ornament which provides its own means to connect to a Christmas tree, Hanukkah bush or other plant to be decorated.

These and other objects and advantages of the present invention will become apparent to those skilled in the art after considering the following detailed Specification together with the accompanying drawings wherein:

DETAILED DESCRIPTION OF THE SHOWN EMBODIMENTS

Figure 1:
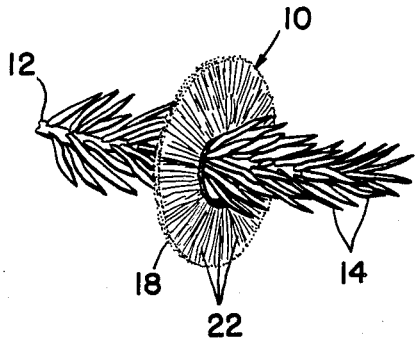
FIG. 1 is a perspective view of the present invention installed on a tree branch.
Figure 2:
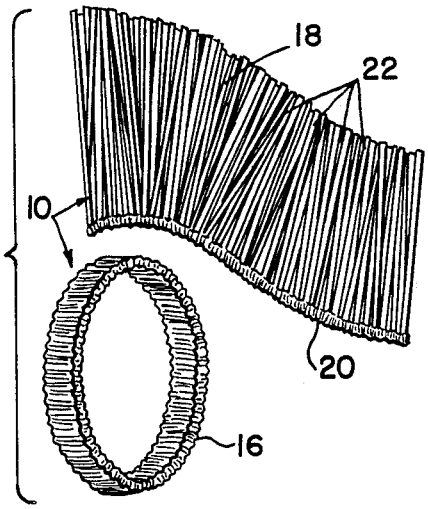
FIG. 2 is a perspective view of the major portions of the present invention prior to their assembly.
Figure 3:
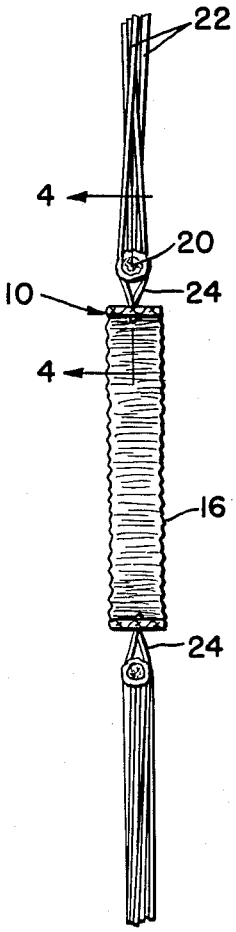
FIG. 3 is an enlarged cross-sectional view of the ornament of FIGS. 1 and 2 after assembly.
Figure 4:
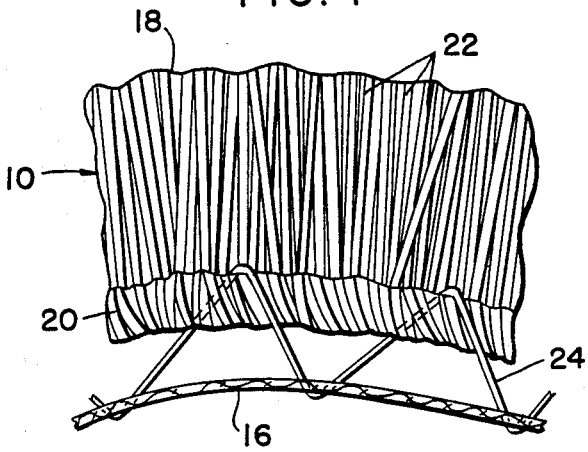
FIG. 4 is an enlarged cross-sectional view taken at lines 4—4 of FIG. 3.

Referring to the drawings more particularly by reference numbers, number 10 in FIG. 1 refers to an ornament mounted as intended normal to a conifer tree branch 12 whose needles 14 grip the ornament 10 and retain it on the branch 12. The ornament 10, as shown in FIG. 2, is constructed from two main components, a central elastic ring 16 and a tinsel rope 18. Suitable tinsel ropes 18 include an elongate flexible cord portion 20 from which extend a plurality of tinsel strips 22. As shown in FIGS. 3 and 4 the tinsel rope 18 is attached to the elastic ring 16 by suitable flexible means such as the thread 24 shown which is looped about the cord portion 20 and sewn through the elastic ring 16. This attachment means causes the tinsel rope 18 to extend radially outward from the elastic ring 16 and yet provides flexibility so that the elastic ring 16 can be expanded over the needles 14 of a branch 12 for attachment thereto. When constructed in this manner, the ornament 10 takes the shape of a disc which allows for easy storage and shipment.

Figure 5:
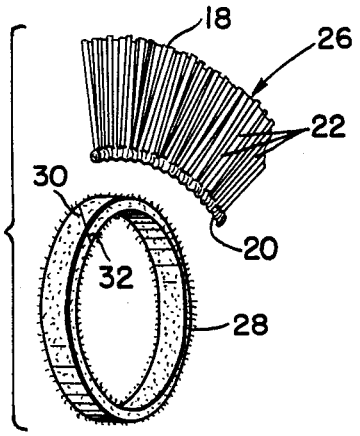
FIG. 5 is a perspective view similar to FIG. 2 showing the major portions of a modified embodiment of the present invention prior to their assembly.
Figure 6:
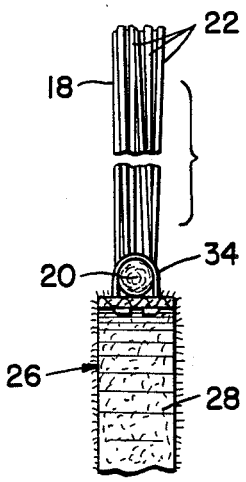
FIG. 6 is an enlarged detailed cross-sectional view of the ornament of FIG. 5 after assembly.

The modified ornament 26, shown in FIGS. 5 and 6 has the tinsel rope 18, but includes a stiff annular member 28 in substitution for the elastic ring 16. The stiff annular member 28 is constructed from a strip of material having diagonally scarfed ends 30 and 32 which are connected together, such as by gluing, to form the annular member 28. The tinsel rope 18 may be attached as before. However, since the member 28 is stiff, the tinsel rope 18 may be glued to the member 28, or as shown in FIG. 6, connected using staples 34. The staples 34 preferably extend around the cord portion 20 of the tinsel rope 18 and through the annular member 28.

Figure 7:
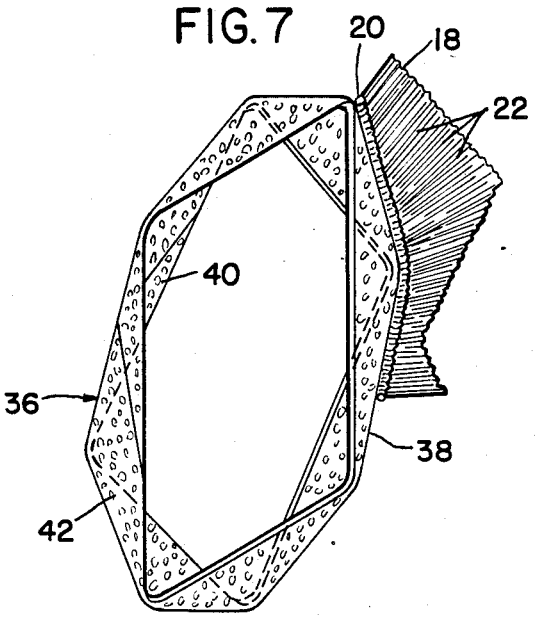
FIG. 7 is a perspective view of a third embodiment showing a decorative center portion and an optional tinsel rope ring which has been trimmed into the shape of the Star of David.

As shown, the ornament 36 of FIG. 7 may include a decorative annular member 38 which is a band folded over into a planar configuration instead of the ring configuration of member 28. Since the annular member 38 is decorative having glitter, painting or other decoration on its inner and outer surfaces 40 and 42, it may be used with or without tinsel rope 18. As shown, with only a portion of the tinsel rope 18, the cord portion 20 is glued to the member 38. The tinsel strips 22 can be trimmed, as shown, so that instead of a halo, the tinsel strips 22 form a Star of David or other pleasing shape which may or may not have religious significance.

Figure 8:
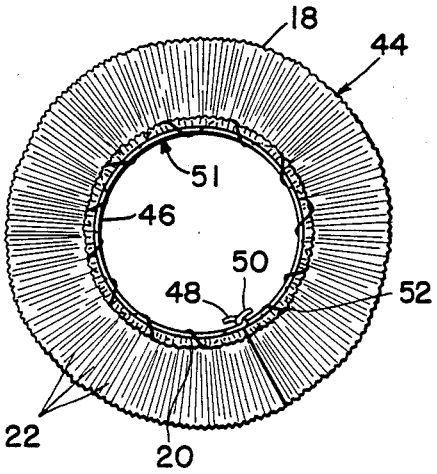
FIG. 8 is a side elevational view of another embodiment of the present invention having a wire connectable at its ends into a wire loop to form the center portion of the ornament.
Figure 9:
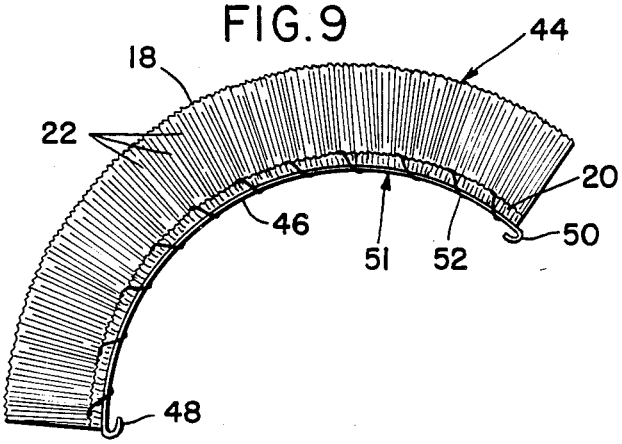
FIG. 9 is a side elevational view of the ornament of FIG. 8 in its unhooked condition.

In the ornament 44, shown in FIGS. 8 and 9, a wire 46 having hooked ends 48 and 50 is used as the annular member 51 of the ornament 44. As shown in FIG. 8, the wire 46 can be connected together at its hooked ends 48 and 50 to form the halo shaped ornament 44 or the hooked ends 48 and 50 can be released for attachment, removal or storage. The tinsel rope 18 is connected with its tinsel strips 22 extending outwardly, as is the case in the other ornaments 10, 26 and 36, with suitable flexible means such as thread 52 wrapped around the cord portion 20 of the tinsel rope 18 and the wire 46 to retain the two together.

Thus there has been shown and described a novel ornament which fulfills all of the objects and advantages sought therefore. Many changes, modifications, variations and other uses and applications of the subject invention will, however, become apparent to those skilled in the art after considering this Specification and the accompanying drawings. All such changes, modifications, variations and other uses and applications which do not depart from the spirit and scope of the invention are deemed to be covered by the invention which is limited only by the claims which follow:

What is claimed is:

1. A decorative ornament for mounting on a tree branch, the ornament comprising:

a central annular member adapted and sized for disposition in relatively closely-spaced relation about the tree branch, the annular member having a radially outward surface and a radially inward surface, and decorative means extending from the outward surface, said decorative means comprising decorative strips and a cord connecting said decorative strips together to form a decorative rope, the decorative strips extending radially outwardly from the outward surface of the annular member.

2. The decorative ornament defined in claim 1 wherein said decorative strips are of different lengths to form a pleasing shape.

3. A decorative ornament for mounting on a tree branch, the ornament comprising:

a central annular member adapted and sized for disposition in relatively closely-spaced relation about the tree branch, the annular member having a radially outward surface and a radially inward surface, decorative elements extending from the outward surface, the tree branch being an evergreen tree branch having needles, and the ornament being sized and adapted for disposition about an end portion of the evergreen tree branch and to compress needles of the branch outer portion to provide a retaining action on the annular member.

4. The decorative ornament defined in claim 3 wherein said decoration means includes:

decorative strips extending radially outwardly from said first surface of said annular member.

5. The decorative ornament defined in claim 3 wherein said annular member is constructed from an elastic ring.

6. The decorative ornament defined in claim 3 wherein said annular member is constructed from a relatively stiff wire having opposite ends with hooks formed thereon, said annular member being formed when said hooks are connected to each other.

7. The decorative ornament defined in claim 4 wherein said strips are tinsel of different lengths to form a pleasing edge shape.

* * * * *

UNITED STATES PATENT AND TRADEMARK OFFICE

CERTIFICATE OF CORRECTION

PATENT NO. : 4,886,688

DATED : Dec. 12, 1989

INVENTOR(S) : Alice E. S z abo

It is certified that error appears in the above-identified patent and that said Letters Patent is hereby corrected as shown below:

Column 4, line 23, delete "first" and insert --radially outward--.

Signed and Sealed this

Fifteenth Day of January, 1991

*Attest:*

HARRY F. MANBECK, JR.

*Attesting Officer*

*Commissioner of Patents and Trademarks*